US008740053B2

(12) United States Patent
Snyder

(10) Patent No.: US 8,740,053 B2
(45) Date of Patent: Jun. 3, 2014

(54) DISPLAY READY CONTAINER ASSEMBLY

(75) Inventor: Bradley D. Snyder, North Wales, PA (US)

(73) Assignee: Innovative Packaging Designs L.P., Montgomeryville, PA (US)

( * ) Notice: Subject to any disclaimer, the term of this patent is extended or adjusted under 35 U.S.C. 154(b) by 404 days.

(21) Appl. No.: 13/042,637

(22) Filed: Mar. 8, 2011

(65) Prior Publication Data

US 2011/0215137 A1 Sep. 8, 2011

Related U.S. Application Data

(60) Provisional application No. 61/311,726, filed on Mar. 8, 2010.

(51) Int. Cl.

| | |
|---|---|
| ***B65D 5/54*** | (2006.01) |
| ***B65D 17/32*** | (2006.01) |
| ***B65D 43/02*** | (2006.01) |

(52) U.S. Cl.

USPC ... 229/123.2; 206/736; 229/117; 229/125.19; 229/125.32

(58) Field of Classification Search

USPC ..... 229/117, 117.03, 123.2, 125.19, 229/125.32, 210, 211; 206/736, 746, 774

See application file for complete search history.

(56) References Cited

U.S. PATENT DOCUMENTS

| | | | | |
|---|---|---|---|---|
| 3,187,976 | A * | 6/1965 | Struble | 229/125.32 |
| 5,447,225 | A * | 9/1995 | Gunn et al. | 229/125.32 |
| 5,505,368 | A | 4/1996 | Kanter et al. | |
| 5,507,430 | A * | 4/1996 | Imhoff | 229/125.19 |
| 5,715,993 | A * | 2/1998 | Pareike | 229/125.32 |
| 5,842,576 | A * | 12/1998 | Snow | 206/736 |
| 5,927,593 | A * | 7/1999 | Berkowitz et al. | 229/117 |
| 8,430,296 | B2 * | 4/2013 | Mathieu et al. | 229/125.19 |
| 8,430,297 | B2 * | 4/2013 | Gatrost et al. | 229/240 |
| 2007/0221715 | A1 * | 9/2007 | Tibbels et al. | 229/125.19 |
| 2007/0278282 | A1 * | 12/2007 | Jolley et al. | 229/125.19 |

* cited by examiner

*Primary Examiner* — Gary Elkins
(74) *Attorney, Agent, or Firm* — Fox Rothschild LLP

(57) ABSTRACT

A container preassembly which has an inner sleeve in a flat unopened position disposed within an outer sleeve in a flat unopened position. The two sleeves are adapted to form the two ends of the container and are secured together in the aligned relationship of the final open container, thereby allowing the preassembly to be opened into the form of the final container without requiring further adjustment. Once opened, the flaps for forming the container bottom are folded to create a container ready for use. A method of making the container preassembly is also provided.

18 Claims, 15 Drawing Sheets

DISPLAY READY CONTAINER ASSEMBLY

CROSS-REFERENCE TO RELATED APPLICATIONS

This application claims the benefit of U.S. Provisional Application No. 61/311,726, filed Mar. 8, 2010, and which is hereby incorporated herein by reference in its entirety.

BACKGROUND OF THE INVENTION

1. Field of the Invention

The present invention pertains to containers used for packaging, shipping, and displaying goods. More particularly, the invention relates to containers formed from at least two sections.

2. Description of the Related Art

Display ready two-piece containers are widely used for shipping and marketing products. Such containers are especially popular in warehouse-type marketing settings and supermarkets where many containers are opened to display the food or merchandise within and stacked one on top of another. Examples include containers of packaged candy which may be decorated for display purposes. The containers of candy are shipped to the store in stacked form. Store personnel remove the tops of the containers, and, in many cases, fold down or remove a display panel which allows the candy within to be seen and removed.

The present invention improves the two-piece container to create one that is more useful and cost effective. The present invention is an improvement over the container disclosed in U.S. Pat. No. 5,505,368, which is hereby incorporated herein by reference.

SUMMARY OF THE INVENTION

The invention disclosed herein relates to an improved container and method of making and using the same. In one aspect, the invention relates to a container knockdown assembly capable of being erected from a substantially flat knockdown configuration to an erect container assembly. The knockdown assembly is formed from an outer sleeve having panels for forming outer sleeve side walls, and flaps integrally connected to the side walls at one end. The flaps form either a bottom end or a top end of said container assembly when the knockdown assembly is erected. Positioned within the outer sleeve is an inner sleeve, also having panels for forming inner sleeve side walls and flaps integrally connected to said side walls at one end. The flaps of the inner sleeve form an opposing of said bottom end or said top end of said container assembly when said knockdown assembly is erected.

One or more adhesive overlays are formed in the one or more inner sleeve side walls by a tear line that allows the overlay to be detached from the inner sleeve along said tear line. An opening is formed at one end of each adhesive overlay. This opening is adapted to receive a tab extending from at least one flap of the outer sleeve such that, when said knockdown assembly is erected, the tab and opening interlock and affix the container assembly in the erect configuration. An adhesive is disposed between the outer sleeve side wall and the overlay to secure the inner and outer sleeves in an aligned relationship and such that the adhesive overlay remains attached to said outer sleeve when detached from said inner sleeve. While not limited thereto, in one embodiment, the adhesive is a hot melt glue.

The inner sleeve may include one or multiple overlays, each of which are independently adhered to said outer sleeve by an adhesive. In certain embodiments, the container knockdown assembly includes least two adhesive overlays spaced from one another on opposing side walls of said inner sleeve.

The aligned relationship of the inner and outer sleeve may include, but is not limited to, any embodiment thereof discussed herein or otherwise any embodiment wherein the inner and outer sleeves are aligned to be convertible from a knockdown configuration to an erected container configuration. In certain embodiments, an edge of the inner sleeve side walls align with a first fold line between said outer sleeve side walls and outer sleeve flaps. The outer sleeve flaps are then folded along this first fold line back toward the inner sleeve side wall and into a central space of the knockdown assembly. In further, optional, embodiments, a second fold line may be provided adjacent to the first fold line to facilitate folding the outer sleeve back toward said inner sleeve side walls and to encase the edge of the inner sleeve side walls.

In alternative embodiments and/or adaptations of the foregoing, the present invention relates to a container knockdown assembly capable of being erected into a container assembly having an outer sleeve forming a bottom end of the container and an inner sleeve forming a top end. Specifically, the outer sleeve includes panels for forming outer sleeve side walls, and flaps integrally connected to said side walls at one end for forming the bottom end when the container assembly is erected. The inner sleeve is positioned inside said outer sleeve and, similarly, includes panels for forming inner sleeve side walls. Flaps integrally connected to the side walls at one end of the inner sleeve form a top end of the container assembly when it is erected from the knockdown configuration.

One or more adhesive overlays are formed in the one or more inner sleeve side walls by a tear line, which allows the overlay to be detachable from the inner sleeve along said tear line. An opening is formed at one end of each of each adhesive overlay, which in certain embodiments is adjacent to a bottom edge of the side walls of the inner sleeve. This opening is adapted to receive a tab extending from at least one flap of the outer sleeve such that, when said knockdown assembly is erected, the tab and opening interlock and affix the container assembly in the erect configuration. Adhesive is disposed between the outer sleeve side wall and the overlay to secure the inner and outer sleeves in an aligned relationship and such that the adhesive overlay remains attached to said outer sleeve when detached from said inner sleeve. While not limited thereto, in one embodiment, the adhesive is a hot melt glue.

The inner sleeve may include one or multiple overlays, each of which are independently adhered to said outer sleeve by an adhesive. In certain embodiments, the container knockdown assembly includes least two adhesive overlays spaced from one another on opposing side walls of said inner sleeve.

The aligned relationship of the inner and outer sleeve may include, but is not limited to, any embodiment thereof discussed herein or otherwise any embodiment wherein the inner and outer sleeves are aligned to be convertible from a knockdown configuration to an erected container configuration. In certain embodiments, an edge of the inner sleeve side walls align with a first fold line between said outer sleeve side walls and outer sleeve flaps. The outer sleeve flaps are then folded along this first fold line back toward the inner sleeve side wall and into a central space of the knockdown assembly. In further, optional, embodiments, a second fold line may be provided adjacent to the first fold line to facilitate folding the outer sleeve back toward said inner sleeve side walls and to encase the edge of the inner sleeve side walls.

In further aspects of the invention, the outer sleeve flaps are pivotal about the bottom end of said outer sleeve side walls from a position within a central space of said assembly to a position substantially perpendicular to said side walls thereby forming said bottom end of said container assembly. The bottom flaps include a first bottom flap attached to a first outer sleeve side wall and an adjacent bottom flap attached to an adjacent outer sleeve side wall. The adjacent outer sleeve side wall is pivotably attached to said first side wall, and the adjacent bottom flap is pivotably attached to said first bottom flap in both said position within said central space (i.e. the knockdown configuration) and said position substantially perpendicular to said side walls (i.e. the erected container configuration). To this end, when pivoting the said first and adjacent bottom flaps into said position substantially perpendicular to said side walls (i.e. converting the knockdown to the container configurations), the container bottom self-deploys.

Additional embodiments and advantages will be readily apparent to one of skill in the art, based on the disclosure provided herein.

BRIEF DESCRIPTION OF THE DRAWINGS

The foregoing summary, as well as the following detailed description, will be better understood when read in conjunction with the accompanying drawings. For the purpose of illustrating the invention, there is shown in the drawings a preferred embodiment. It is understood, however, that this invention is not limited to the precise arrangement shown.

DETAILED DESCRIPTION

The invention disclosed herein is an improved container and method of making and using the same. Described below is an embodiment particularly suited for containers used for shipping and displaying goods for retail. It is understood, however, that the present invention can be adapted to containers used for other purposes.

Figure 1:
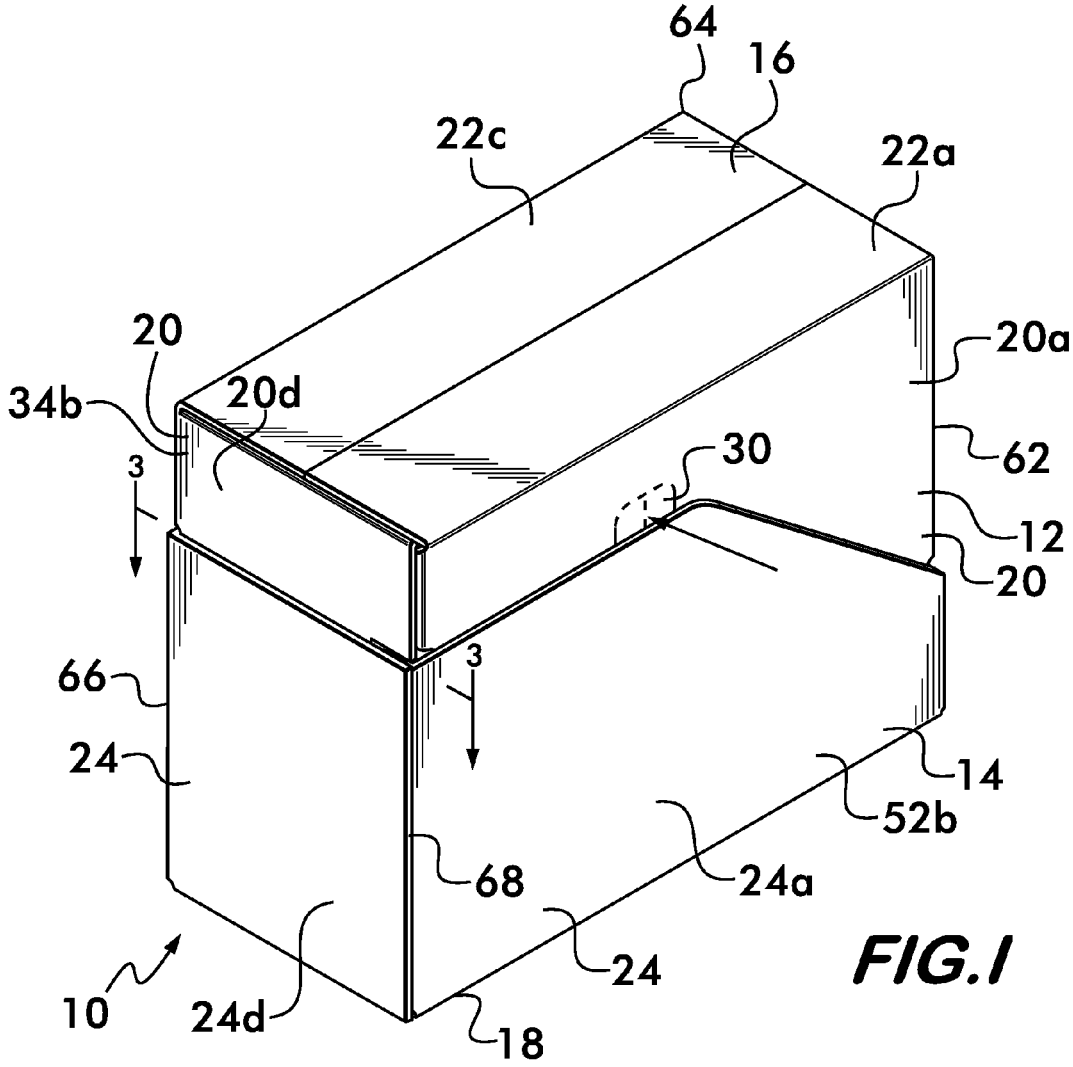
FIG. 1 is a perspective view of a container made in accordance with the present invention showing the outer and inner container sections in an assembled and closed form.
Figure 2:
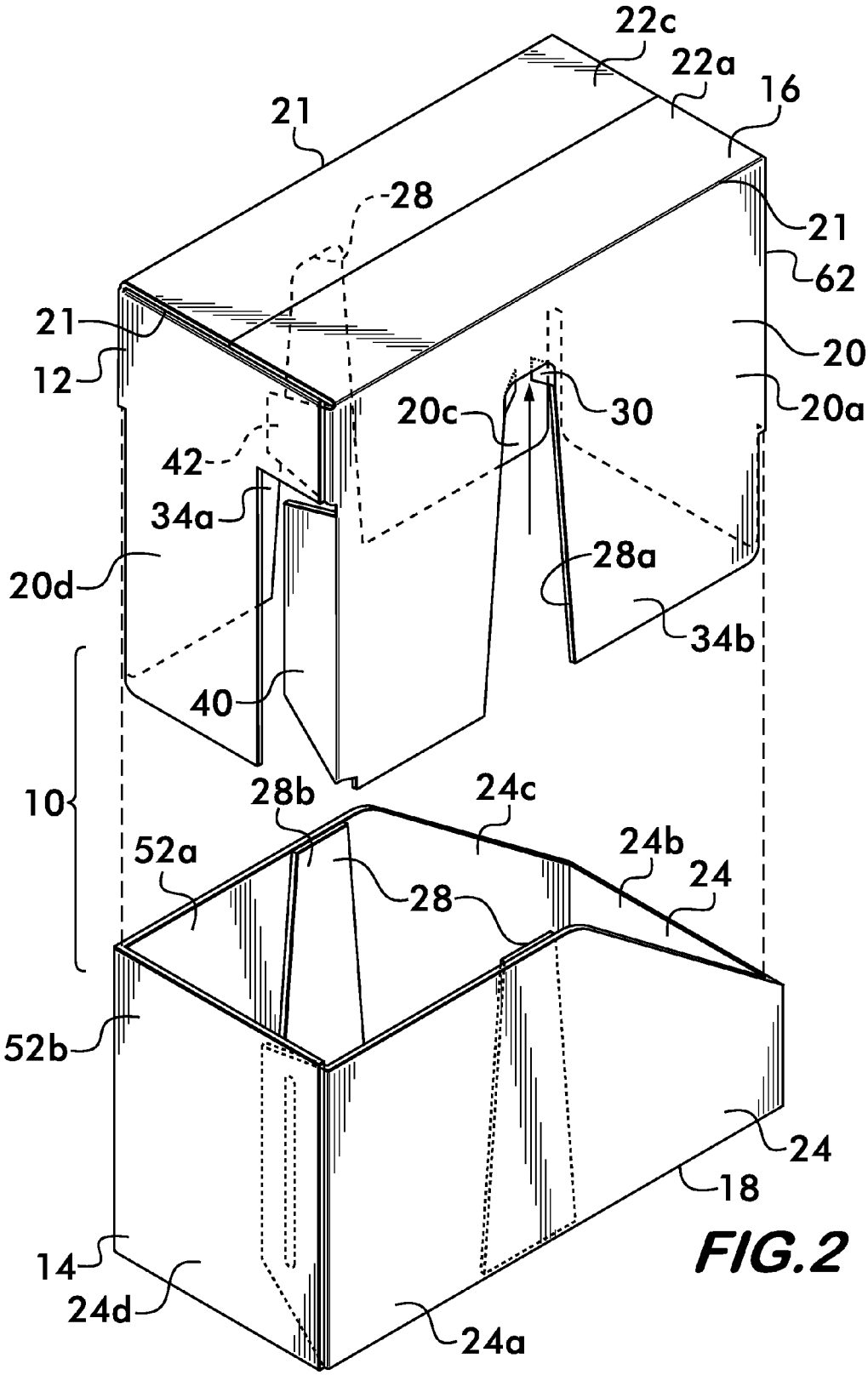
FIG. 2 is a perspective view of the container of FIG. 1 shown with the inner upper section detached and removed from the outer bottom section.
Figure 3:
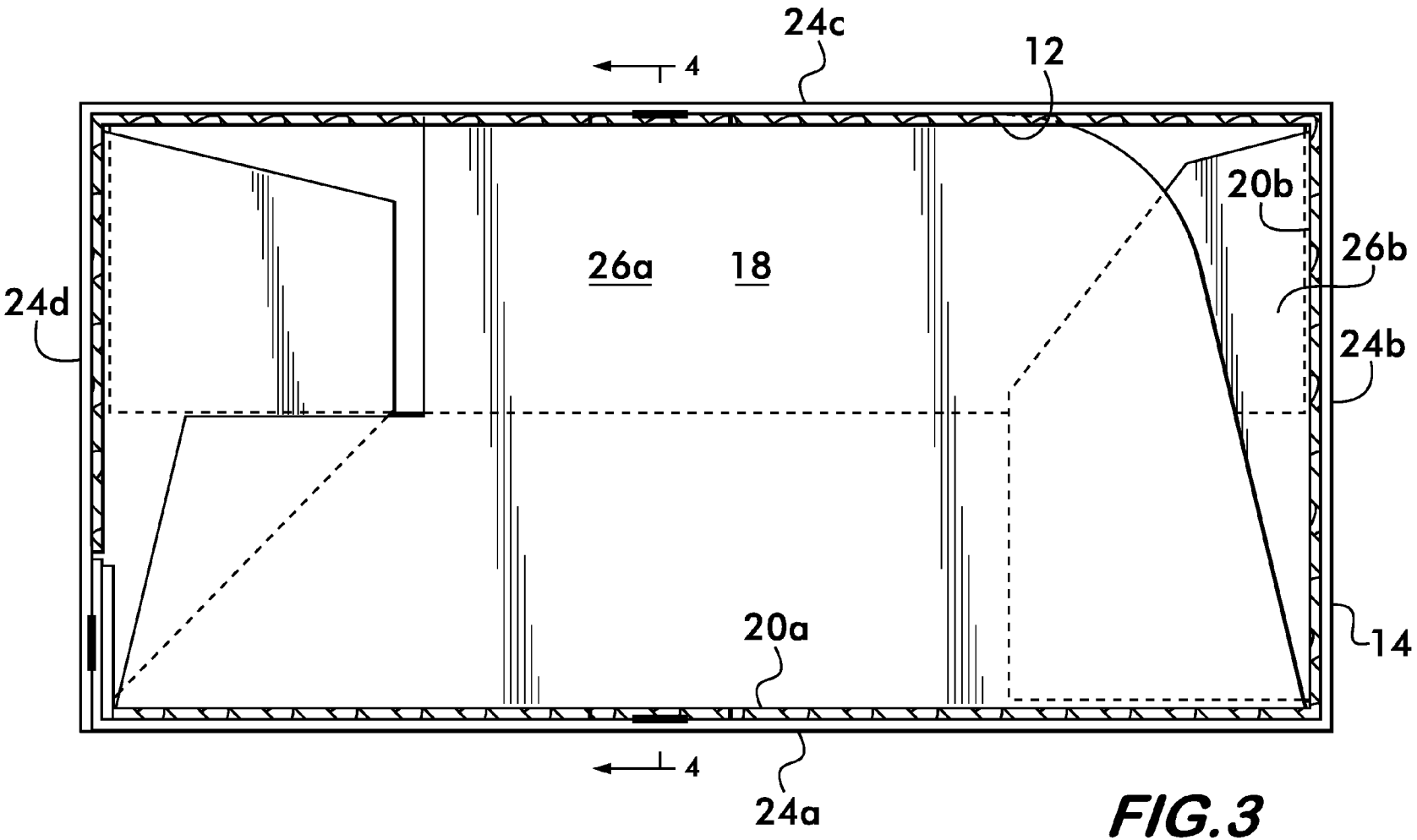
FIG. 3 is a cross sectional view taken along line 3-3 of FIG. 1.
Figure 4:
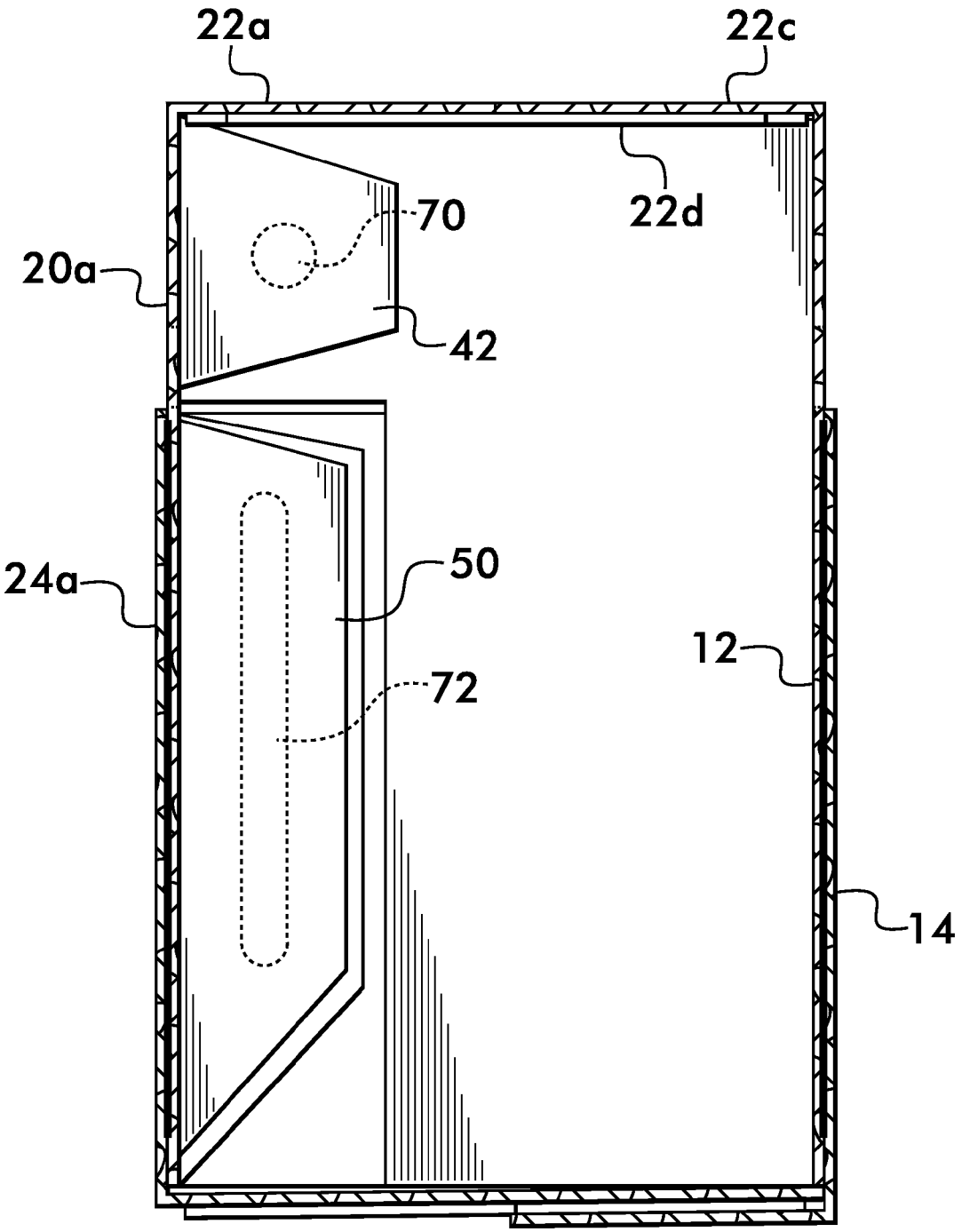
FIG. 4 is a cross sectional view taken along line 4-4 of FIG. 3.

Reference now will be made in detail to a presently preferred embodiment of the invention, examples of which are illustrated in the accompanying drawings. Illustrated in FIGS. 1 and 2 is a container 10 for shipping and displaying goods. FIG. 1 shows the container 10 in a fully assembled state as it would appear packed with goods and with its top flaps closed for shipping. The container 10 has an inner sleeve 12 adapted to fit within an outer sleeve 14. In the illustrated embodiment the inner sleeve 12 forms the upper section of the container 10, the outer sleeve forms the lower section. Sleeves 12 and 14 comprise the two sections that form the completed container 10 having a top 16 and a bottom 18. Each sleeve can be formed from a blank as further described below.

Inner sleeve 12 includes the top section 16 of the container 10 as shown. It has side walls 20 which include side panels 20*a*, 20*b*, 20*c*, and 20*d*. Integrally attached to the side walls 20 along fold lines 21 is the top 16 formed of top forming foldable flaps 22*a*, 22*b*, 22*c* and 22*d* (see also FIG. 5). The fold lines 21 can be formed as a score or in any known manner.

Outer sleeve 14 has side walls 24 formed of side panels 24*a*, 24*b*, 24*c*, and 24*d*, and 22*d*. Integrally attached to the side walls 24 along fold line 21 is the bottom 18 formed of bottom forming foldable flaps 26*a*, 26*b*, 26*c*, and 26*d* (see FIG. 6). As will be discussed further below, the fold lines of the present embodiment preferably comprise score lines or creases impressed into the container material to aid folding, the terms being used interchangeably throughout this specification.

Figure 5:
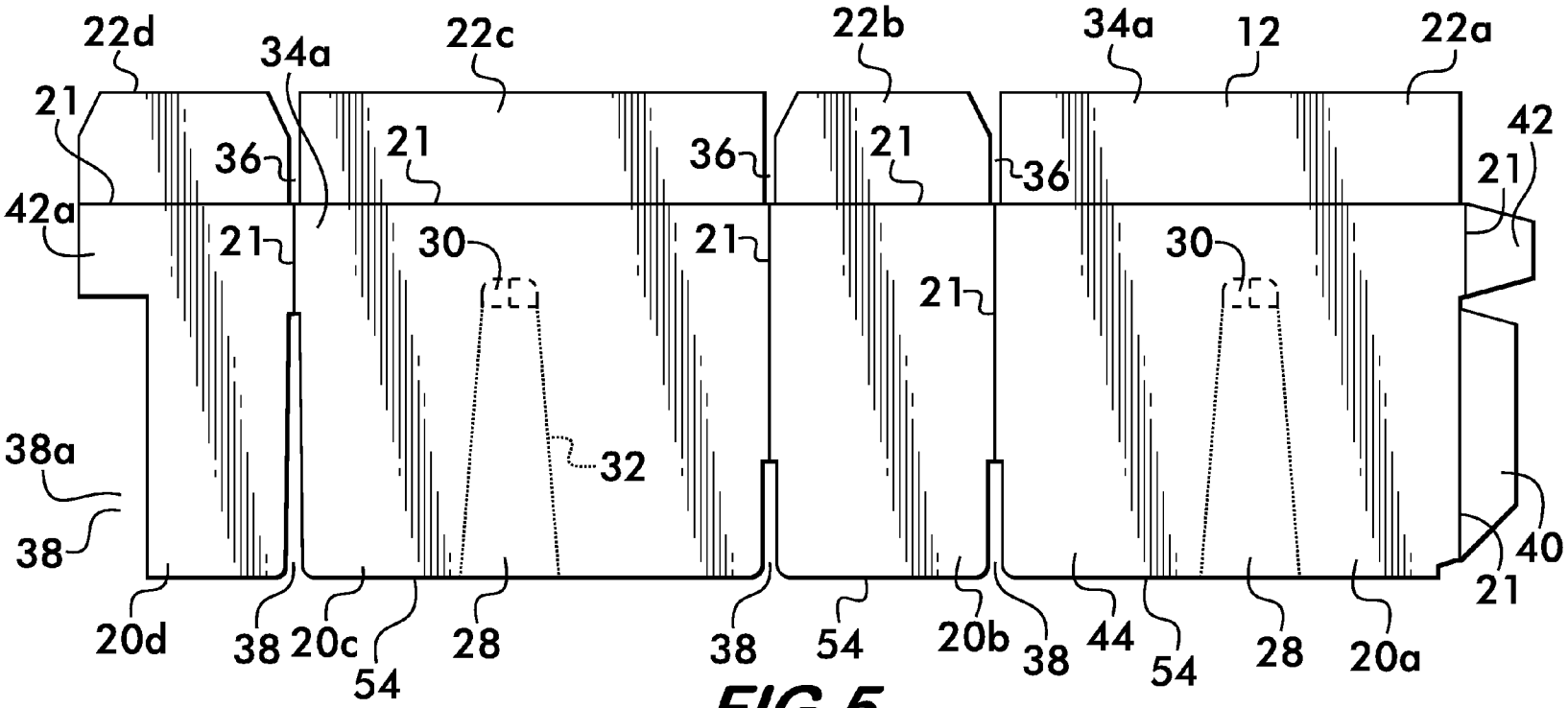
FIG. 5 is a plan view of the blank section for forming the inner upper section of the container in FIG. 1.

As shown, the inner sleeve 12 is adapted to fit within the outer sleeve 14. When shipping goods within the container 10, the outer sleeve 14 is preferably secured to the inner sleeve 12. The inner sleeve 12 includes tear away sections 28 formed as part of panels 20*a*, 20*c*, opposing one another, and which are adjacent to respective finger insert sections 30. The inner and outer sections 12 and 14 are attached to one another via an adhesive along these tear away sections 28. Thus, the tear away sections 28 allow the two sections 12 and 14 to be separated from one another at the retailer or end user for displaying the goods within. With reference to FIGS. 2 and 5, it is seen that the finger insert sections 30 are formed in the wall panels 20*a*, 20*c* via a combination of cuts and fold lines so as to be able to hingeably open and fold inwardly when so urged as shown in FIG. 2. The tear away sections 28 are formed in the wall panels 20*a*, 20*c* via perforations 32 so as to be separable from the remainder of the wall panels 20*a*, 20*c* by tearing as seen in FIG. 2, leaving openings 28*a* when the upper section 12 is removed from the lower section 14. As will be further described below, this separation process can be effected by inserting a thumb into each of the two finger insert sections 30 to grasp the inner face 28*b* of the tear away sections 28 and move them apart from one another so as to tear the tear away section 28 from the remainder of the respective wall panels 20*a*, 20*c*. Once the tear is complete, the inner sleeve section 12 is lifted upwardly for easy removal.

Figure 6:
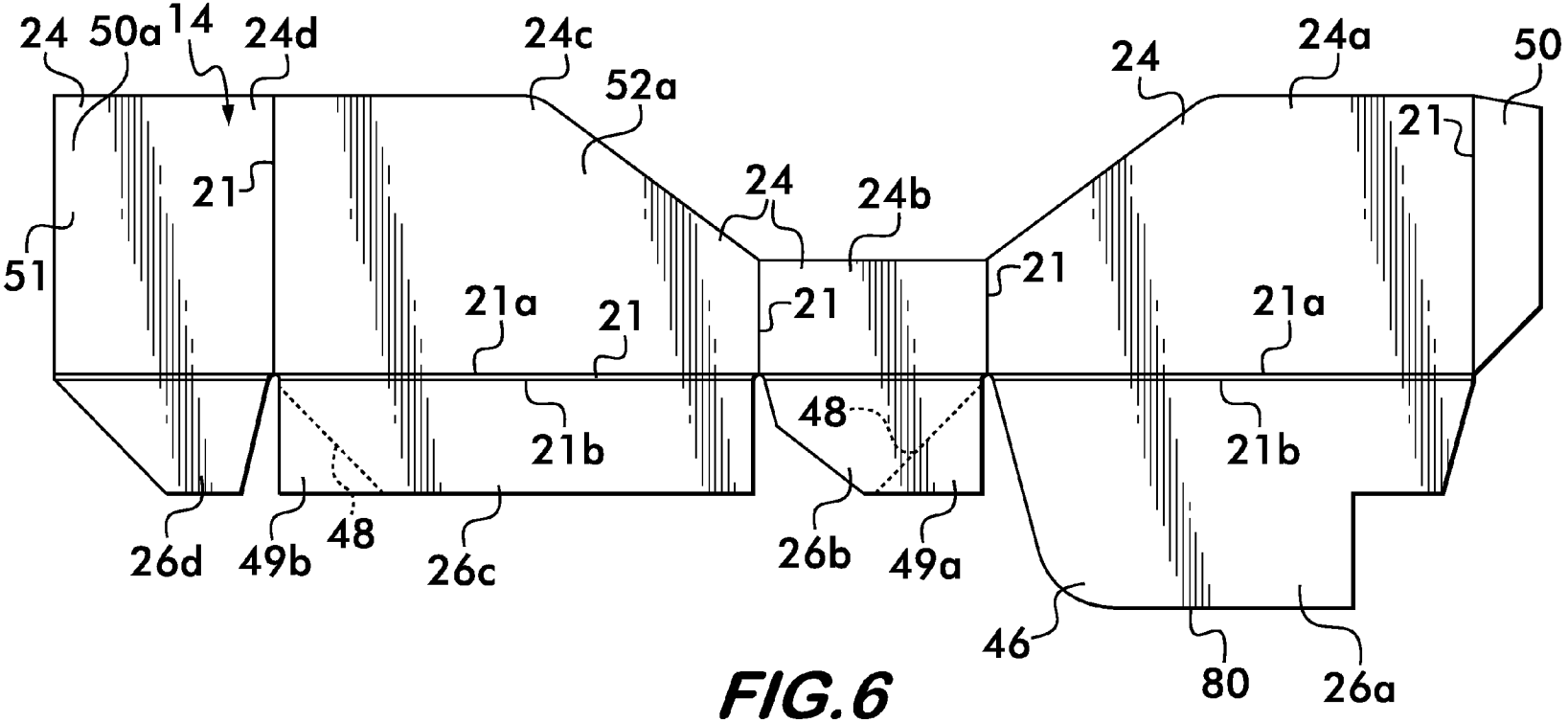
FIG. 6 is a plan view of the blank section for forming the outer lower section of the container in FIG. 1.

Having described the basic elements of the container 10, a method of making and using it is now described. Illustrated in FIGS. 5 and 6 are blanks from which the inner and outer sleeves 12 and 14 may be formed. The sleeves 12 and 14 can be formed from any material suitable for use as a container, including such materials as corrugated board and chipboard, a single integral piece of corrugated board being preferable for forming each sleeve of the illustrated embodiment.

Referring to FIGS. 1, 2 and 5, a blank 44 for forming the inner sleeve 12 is now described. FIG. 5 shows an inner face 34*a* of the sleeve 12, the outer face 34*b* being shown in FIGS. 1 and 2. The inner sleeve 12 has side panels 20*a*, 20*b*, 20*c*, and 20*d* integrally attached to one another for forming the side walls 20. The panels can be separated by fold lines 21 (score or crease) impressed into the blank 44 as shown to act as a fold line and aid in folding. Top forming flaps 22*a*, 22*b*, 22*c*, and 22*d* are integrally attached to respective side panels by fold lines 21, and are separated from each other by clearance spaces 36 to aid in folding. Spaces 38 along the lower end corners of the wall panels 20 as shown provide suitable clearance and flexibility to aid in the fitting of the inner section 12 within the outer section 14. Integral flap 40 fits within the clearance space 38*a* in the assembled sleeve 12; space 38*a* facilitates the application of adhesive to make the container 10 as further discussed below. Integrally attached glue tab 42 is provided to be adhesively attached to the area 42*a* to form the rectangular inner section 12 as is known in the art. It is seen that the inner sleeve 12 is formed by folding the blank 44 along the fold lines (score) 21 to form the inner sleeve walls 20. (It is recognized that the fold lines 21 between the individual walls 20 form the side corners of the inner sleeve 12).

With further reference to FIG. 6, a blank 46 for forming the outer sleeve 14 has side panels 24*a*, 24*b*, 24*c*, 24*d* for forming the side walls 24. The inner face 52*a* of blank 46 is shown, the outer face 52*b* shown in FIGS. 1 and 2. Fold lines comprising score lines 21 are impressed between the side panels to aid in folding the blank 46, and which form the side corners of the outer sleeve 14. The bottom flaps 26*a*, 26*b*, 26*c*, and 26*d* for forming the container bottom 18, integrally attached to respective side panels, are configured in this embodiment to form an auto-forming bottom upon assembly of the container 10 as further described below. Here, the fold line 21 is formed of double score/folding lines 21*a*, 21*b* spaced from one another to allow the folding of the bottom forming panels around the lower edge 54 of respective wall panels 20*a*, 20*b*, 20*c*, 20*d* as further described below. Perforation lines 48 in the bottom flaps 26*b* and 26*c*, forming tabs 49*a*, 49*b*, aid in the formation of the container bottom 18. A glue tab 50 is provided to secure one blank end to the other end 50*a* when forming the sleeve 14 as is known in the art.

Figure 11:
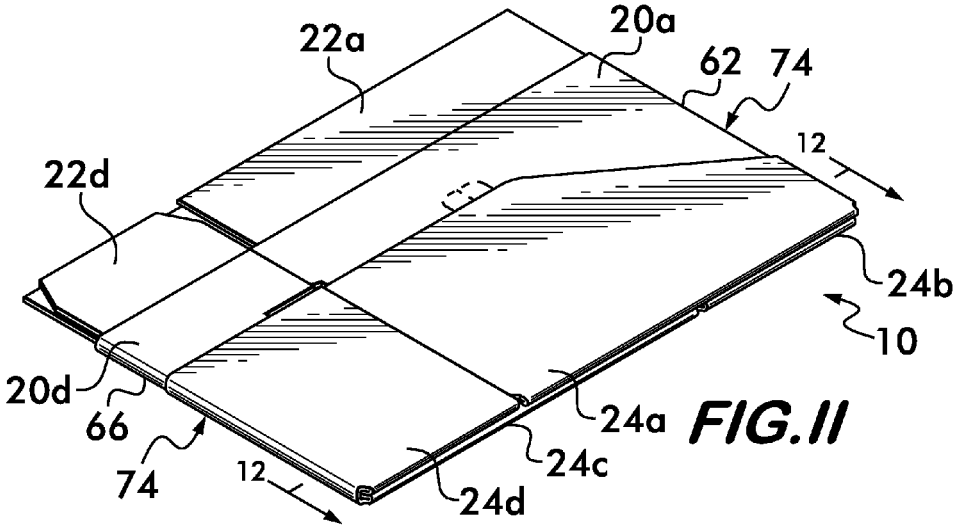
FIG. 11 shows a knockdown form of the container of FIG. 1.

Once formed, the blanks 44 and 46 can be combined to form a flat preassembled container as shown in FIG. 11, referred to herein as a knockdown 74, that can be stored and shipped efficiently and which is easily erected into an open container for 10 shipping goods by people or automated machinery. A preferred method of assembling and using the flat preassembled container is now described.

Figure 7:
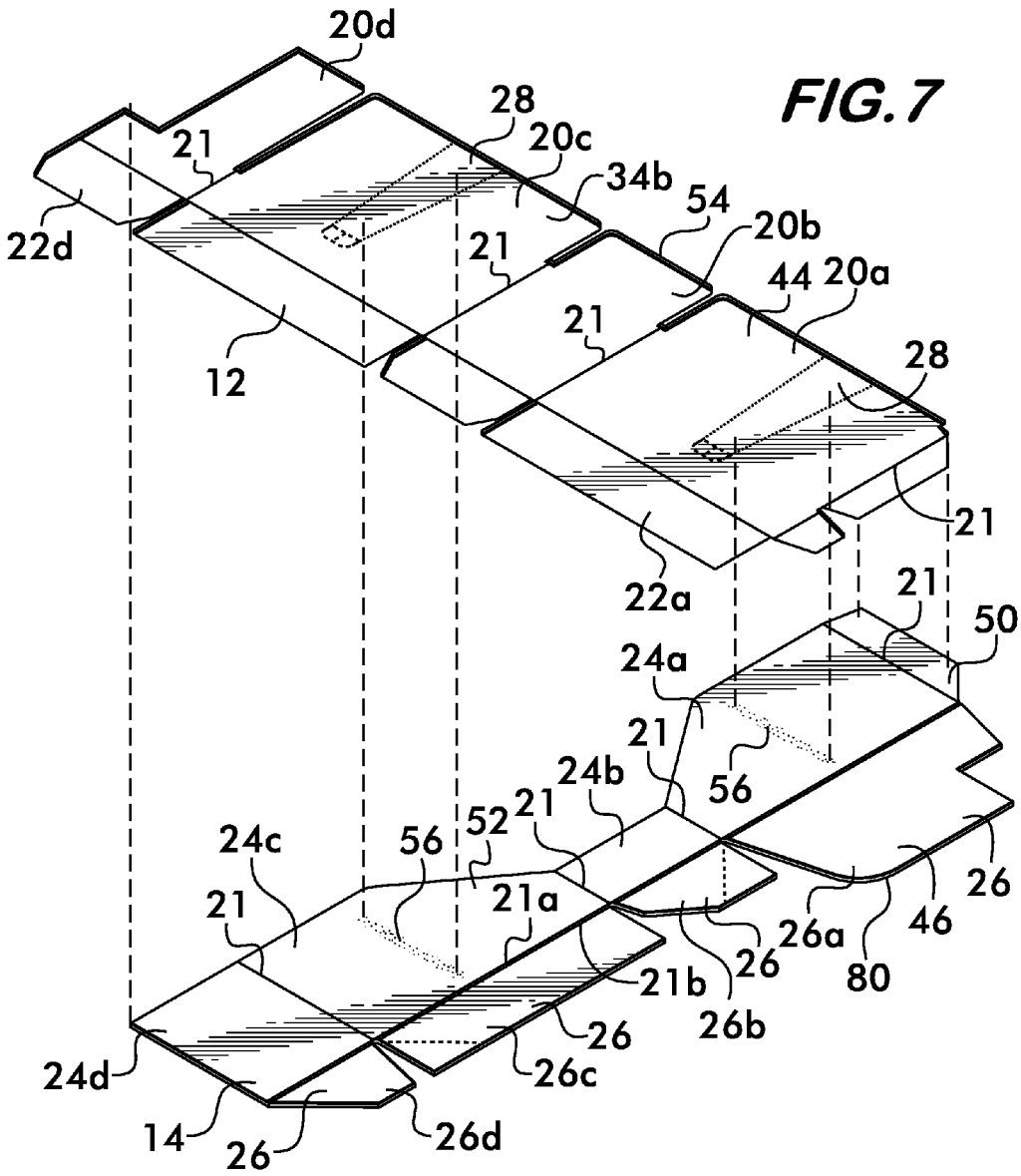
FIG. 7 is a perspective view showing the alignment of the upper and lower blanks relative to one another.
Figure 14:
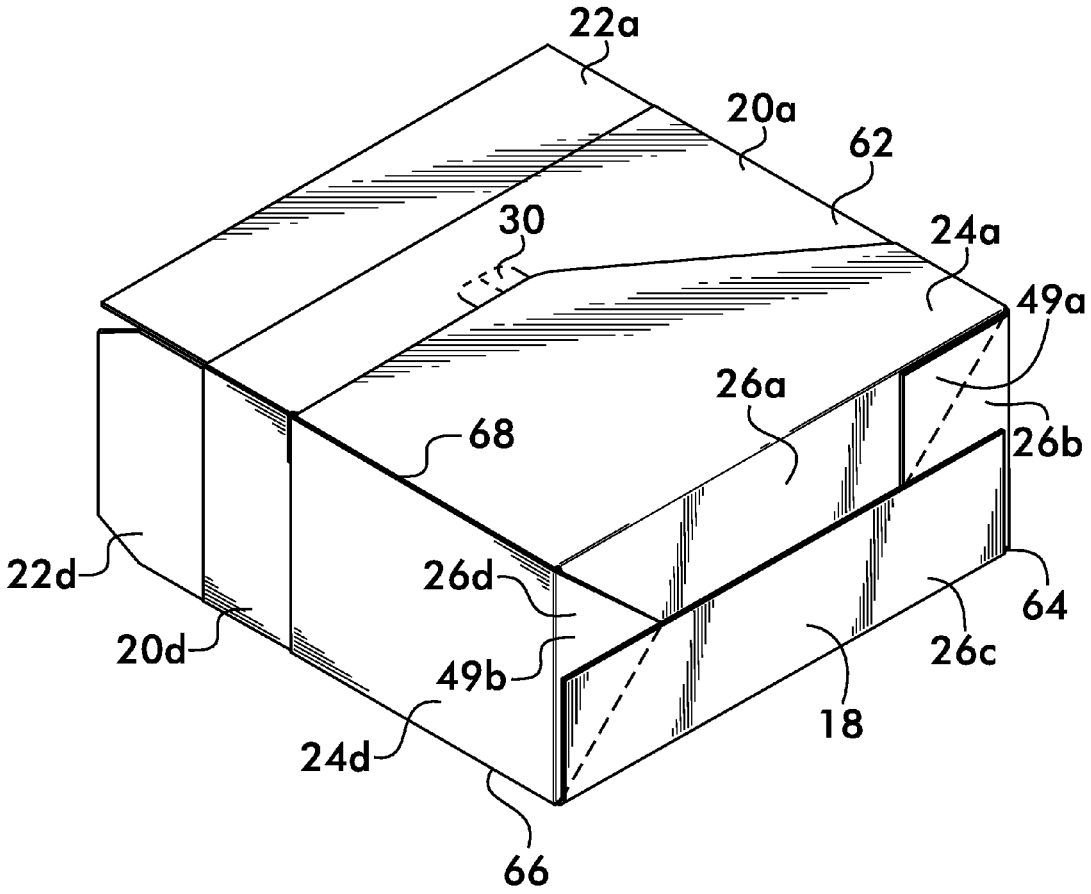
FIG. 14 is a perspective side view showing the container of FIG. 13 in a fully assembled form.
Figure 15:
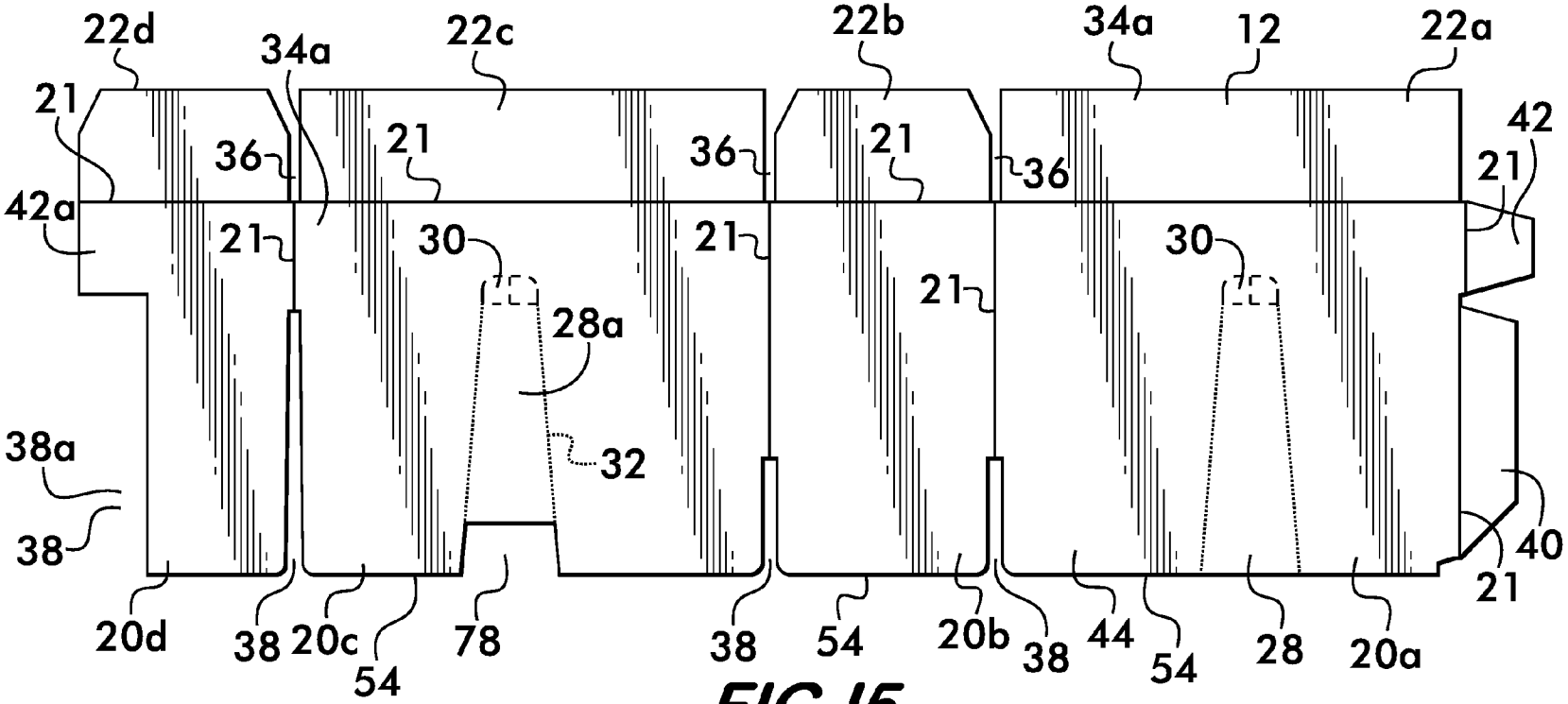
FIG. 15 is a plan view of the blank section for forming the inner upper section of another embodiment of the present invention.

Referring first to FIG. 7, the outer and inner blanks 46, 44 for forming outer and inner sleeve sections are provided in the flat unfolded form as shown in FIGS. 5 and 6. The outer blank 46, sleeve 14, is shown flat with its inner face 52*a* showing (outer face 52*b* facing down). The inner blank 44, sleeve 12, is provided in a flat unopened form with its outer face 34*b* facing the inner face 52*a* of the outer blank 46. The inner and outer blanks 44, 46 are combined in the aligned position relative to one another of the final opened (erected) container 10 and secured together; i.e., the side panels of the blank 44 (inner sleeve 12) align with and are adjacent to the respective side panels of the outer blank 46 (outer sleeve 14) in the same relationship as the final container 10 as illustrated in FIG. 14. Thus, the inner sleeve wall panel 20*a* will align with the outer wall panel 24*a*, etc. The corner forming fold lines 21 of the inner sleeve 12 must align with the respective fold lines 21 of the outer sleeve 14 as these fold lines will form adjacent corners of the inner and outer sleeves 12, 14 of the final container 10, and must align to permit the two sleeves to open together as a single unit. The lower edge 54 of the inner sleeve 12 aligns with the upper fold line 21*a*, the space between fold lines 21*a* and 21*b* allowing folding around the respective lower edge 54 of the panels of blank 44. As a preferred variant, the lower edge 54 can be aligned higher than or spaced from the fold line 21*a* a spacing of at least the thickness of the blank 44 as will be further discussed below. Prior to placing the inner blank 44 onto the outer blank 46, adhesive, such as glue in the form of a glue dot or line of glue, is applied to areas 56 of outer blank 46 for attachment to the tear away sections 28 of inner blank 44.

Figure 8:
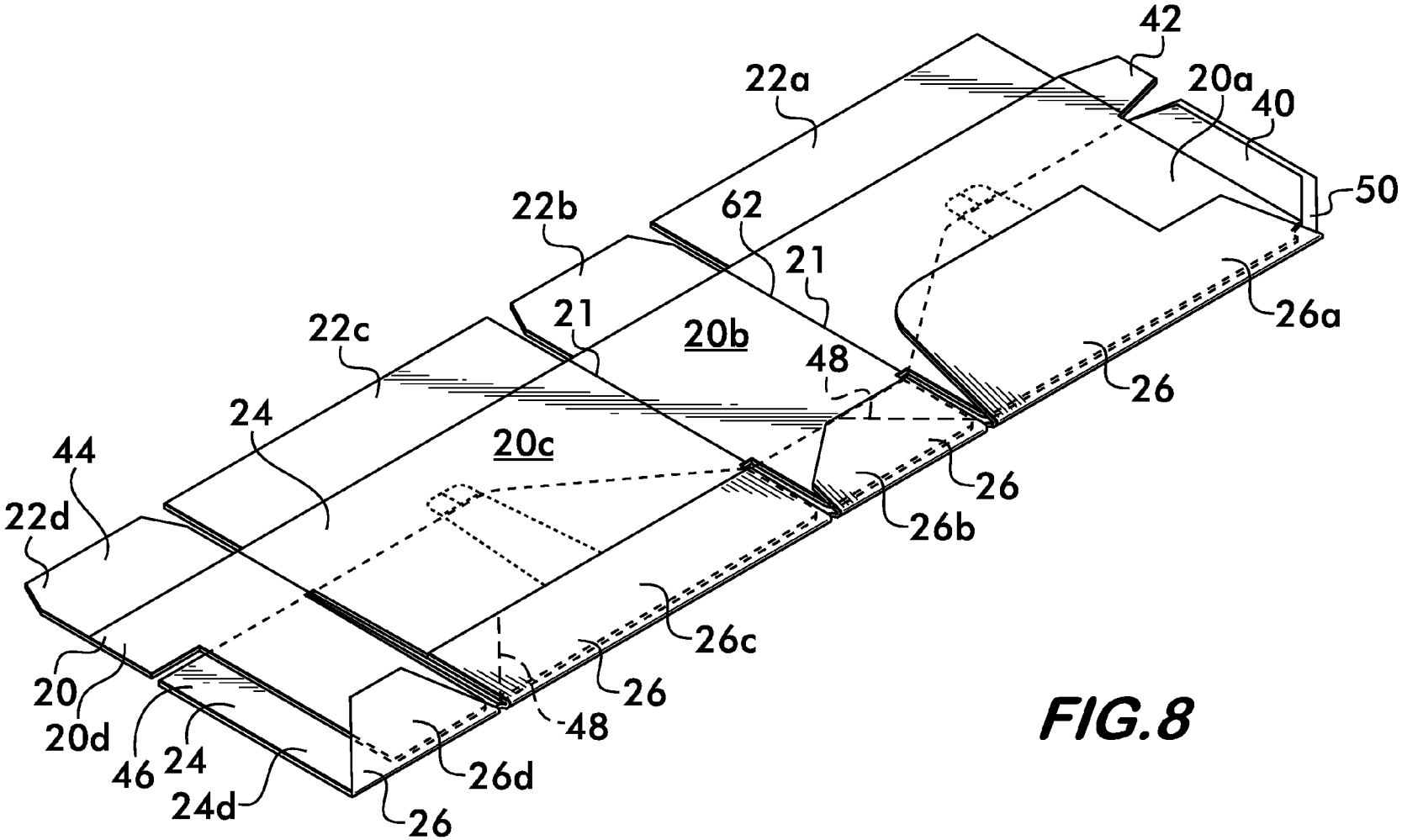
FIG. 8 is a perspective view illustrating a step of making the container of FIG. 1.

Next, with further reference to FIG. 8, the bottom forming flaps 26*a* through 26*d* of the outer blank 46 (outer sleeve 14) are folded around the lower edge 54 (see FIG. 5) of the inner blank 44 to sandwich the lower edge 54 between the wall panels 24 and bottom flaps 26. Next, with further reference to FIG. 9, bottom panel tabs 49*a*, 49*b* are folded about perforation line 48 as shown by arrows 58.

Figure 9:
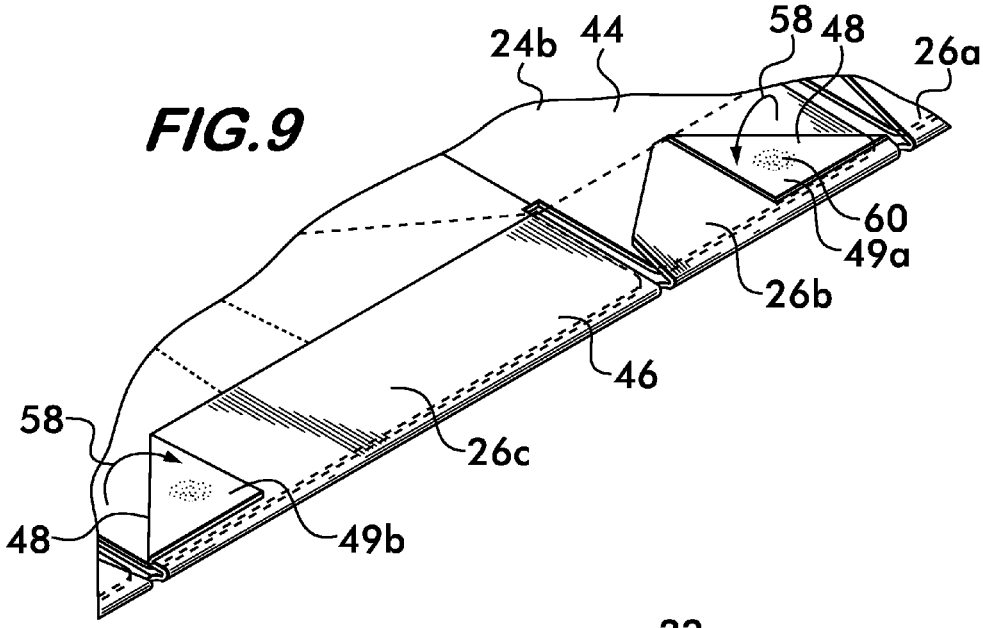
FIG. 9 is a partial view of the lower portion of the container 10 as shown in FIG. 8 with the bottom tabs shown folded.
Figure 10:
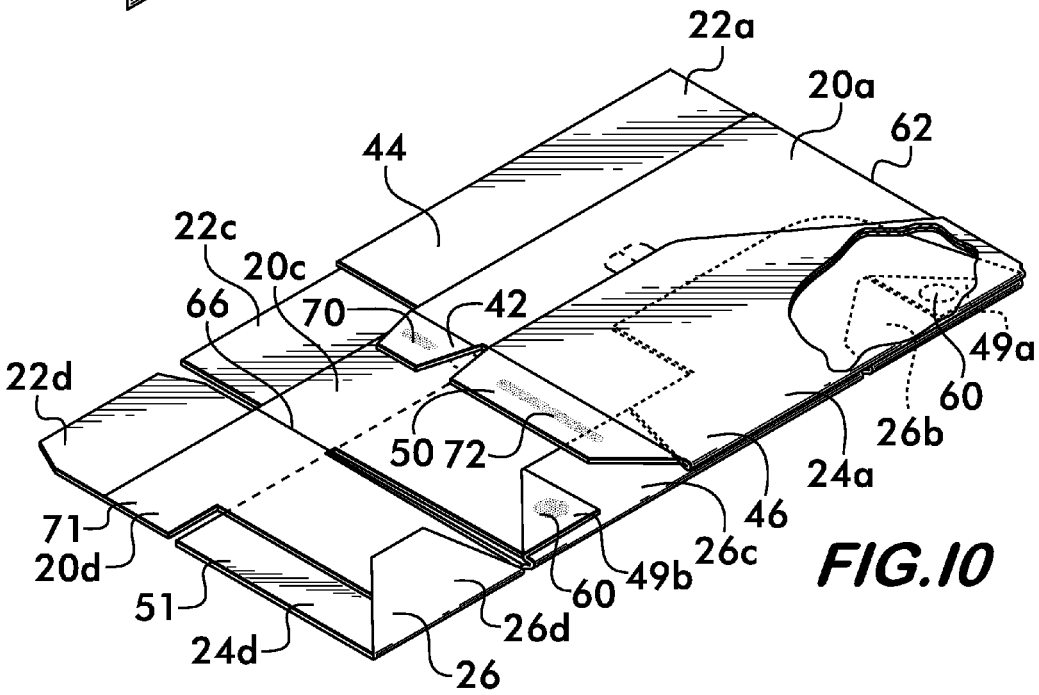
FIG. 10 is a perspective view of the container of FIG. 1 illustrating another step of making the container of FIG. 1.

Next, with further reference to FIG. 10, adhesive, such as glue is applied to the area 60 of the inner face of bottom tab 49*a* (see FIG. 9). Then the inner and outer blanks 44, 46, i.e., panel sections 20*a*, 22*a* of the blank 44 and panel sections 24*a*, 26*a* of the blank 46, are folded together about fold line 62 which also forms container corner 62 (FIG. 1). As illustrated in the cut away portion of FIG. 10, the glue on the area 60 of the bottom panel 26*b* adheres to the adjacent bottom panel 26*a*.

Adhesive, such as glue, is next applied to area 60 of the inner face of bottom tab 49*b*, and also applied to outer face of the area 70 of glue tab 42 (of inner blank 44) and to outer face of the area 72 (of outer blank 46). Then the inner and outer blanks 44, 46, i.e., panel sections 20*c*, 20*d*, 22*c*, 22*d* of the blank 44 and panel sections 24*c*, 24*d*, 26*c*, 26*d*, are folded together about fold line 66 which also forms container corner 66 (see FIG. 1) to form the knockdown state 74 of the container 10 as shown in FIG. 11. As illustrated, the glue on area 60 on bottom flap 49*b* of bottom flap 26*c* adheres to the adjacent bottom flap 26*d*; glue tab 50 of outer blank 46 (outer sleeve 14) adheres to area 51 of the wall panel 24*d* of outer blank 46 (outer sleeve 14) to form the complete sleeve 14; and glue tab 70 of the inner blank 46 (inner sleeve 12) adheres to area 71 of the wall panel 20*d* of the inner blank (inner sleeve 12) to form the completed sleeve 12.

Figure 12:
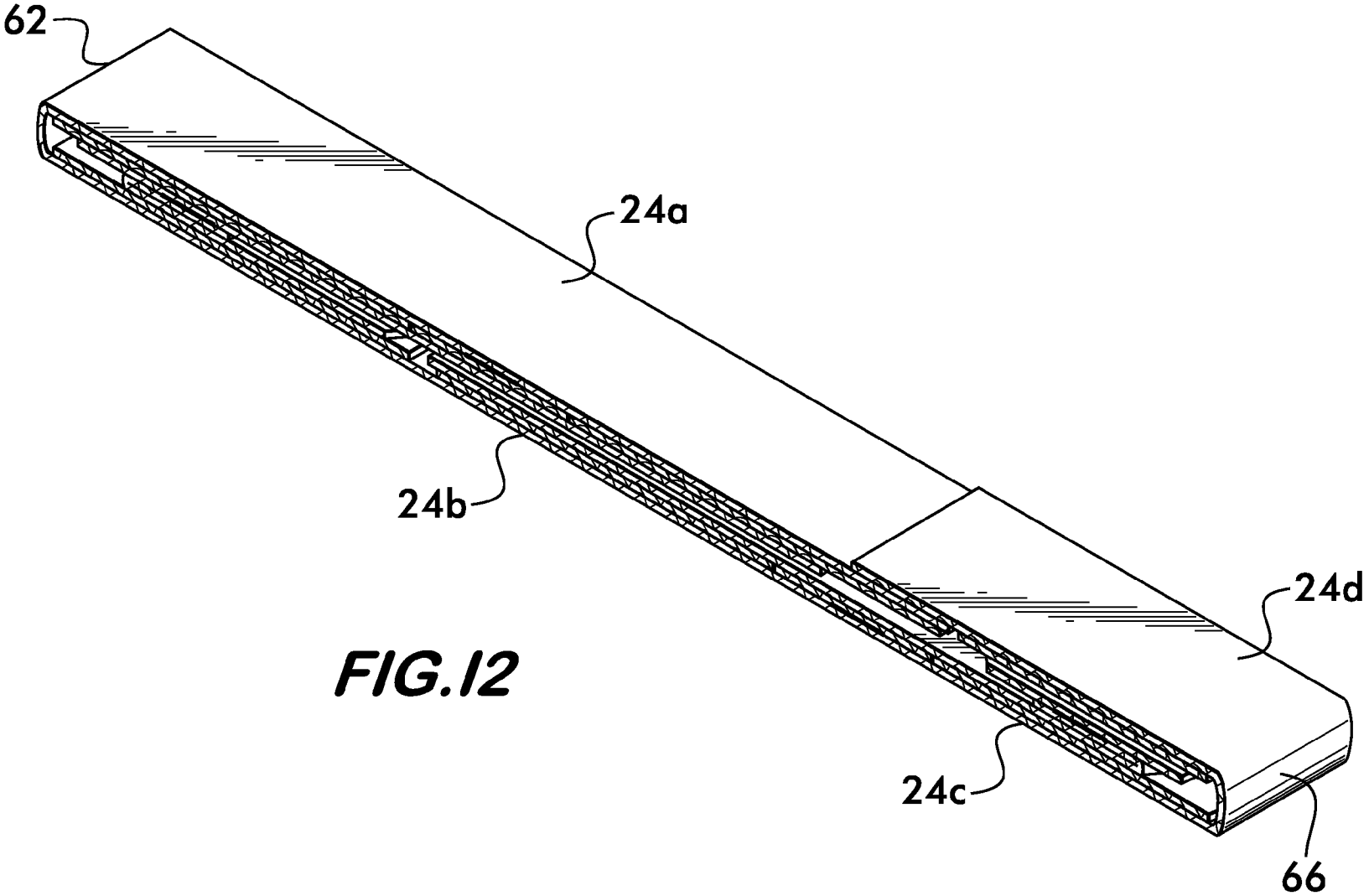
FIG. 12 is a cross sectional view taken along line 12-12 of FIG. 11.

As seen in FIGS. 11 and 12, the outer and inner sleeves 12, 14 are secured together so that a completed container 10 in a knockdown form 74 is formed. Such flat assemblies are efficiently stored and shipped.

Figure 13:
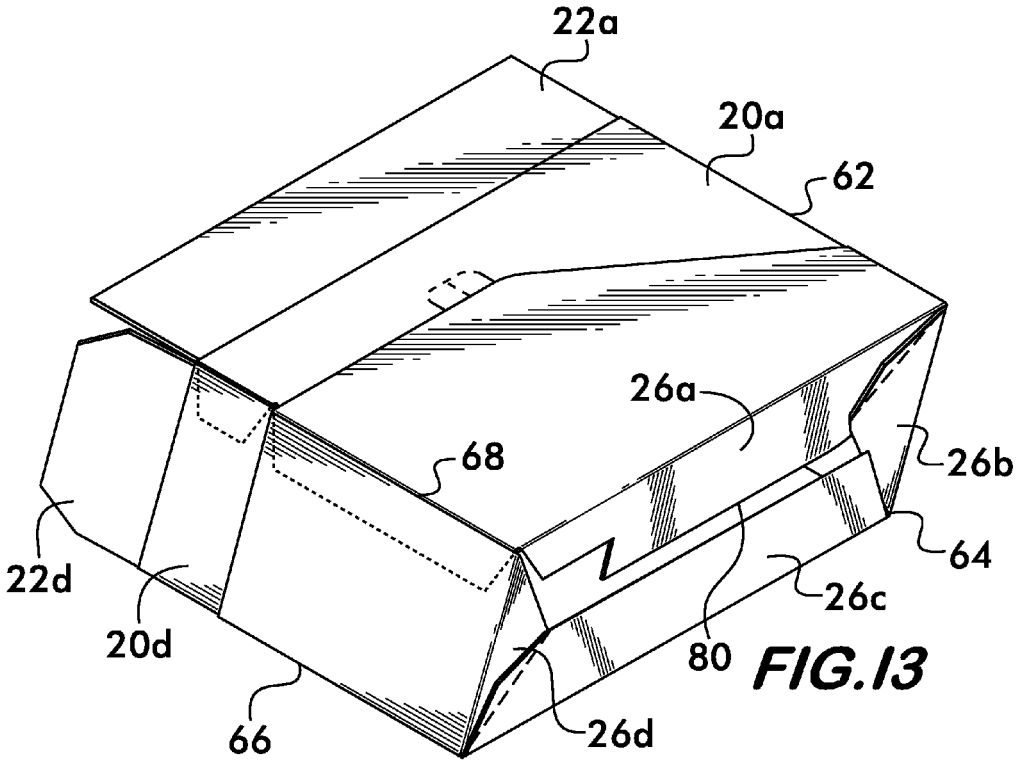
FIG. 13 is a perspective side view showing the container of FIG. 1 shown in a partially assembled state having been partially opened from its knockdown form.

Using the container 10 is simple and efficient. Referring to FIGS. 11, 13, and 14, the user erects the completed flat knockdown container preassembly 74 by urging the ends 62, 66 toward each other, forming corners 64 and 68 and opening up the container as shown in FIG. 13, until an opened container 10 with the inner and outer sleeves 12, 14 secured together is formed as shown in FIG. 14. It is seen that both sleeves 12, 14 open as a single unit, and that the bottom flaps of the illustrated embodiment automatically move into position to close the container bottom in a self locking manner as is known in the art. As seen in FIG. 13, the top flaps 22*a* through 22*d* are open and the container 10 is ready to receive goods. Once loaded with goods, the top flaps 22*a* through 22*d* are folded and secured to form the top as known in the art, thereby enclosing the goods within the container 10 as seen in FIG. 1. At the retailer, with reference to FIG. 2, the inner/upper section 12 is removed by pushing in the finger insert section 30 to separate the tear away section 28 which remains glued to the outer/lower section 14 as seen in FIG. 2. The lower display section 14 can be used to display the goods within. The lower height of the front wall panel 24*b* as compared to the rear wall panel 24*d* provides easy access and display of the goods within. Discussed above was a preferred variant where the lower edge 54 can be aligned higher than the fold line 21*a* a spacing at least the thickness of the blank 44. This allows the edge 80 of the flap 26*a* to lock under the lower edge 54 of the inner side wall panel 20*c*.

The present invention thereby provides a flat container preassembly (knockdown 74) which is simple and efficient to make, and which is easily erected into a completed container 10. Since forming the flat container preassembly 74 as well as erecting and loading the fully formed container requires a few simple steps, the assembly and use of the container is readily automated.

Figure 16:
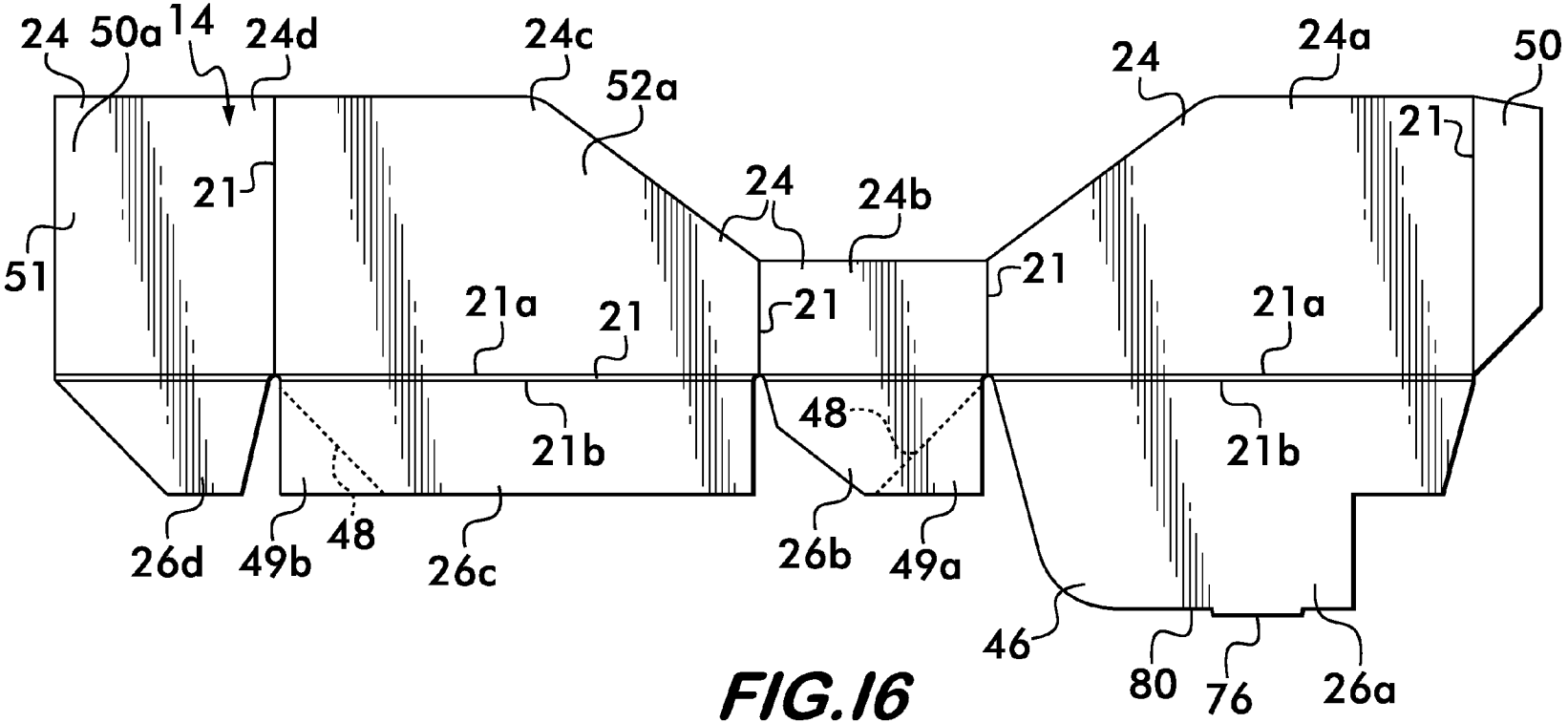
FIG. 16 is a plan view of the blank section for forming the outer lower section of the container in FIG. 16.
Figure 17:
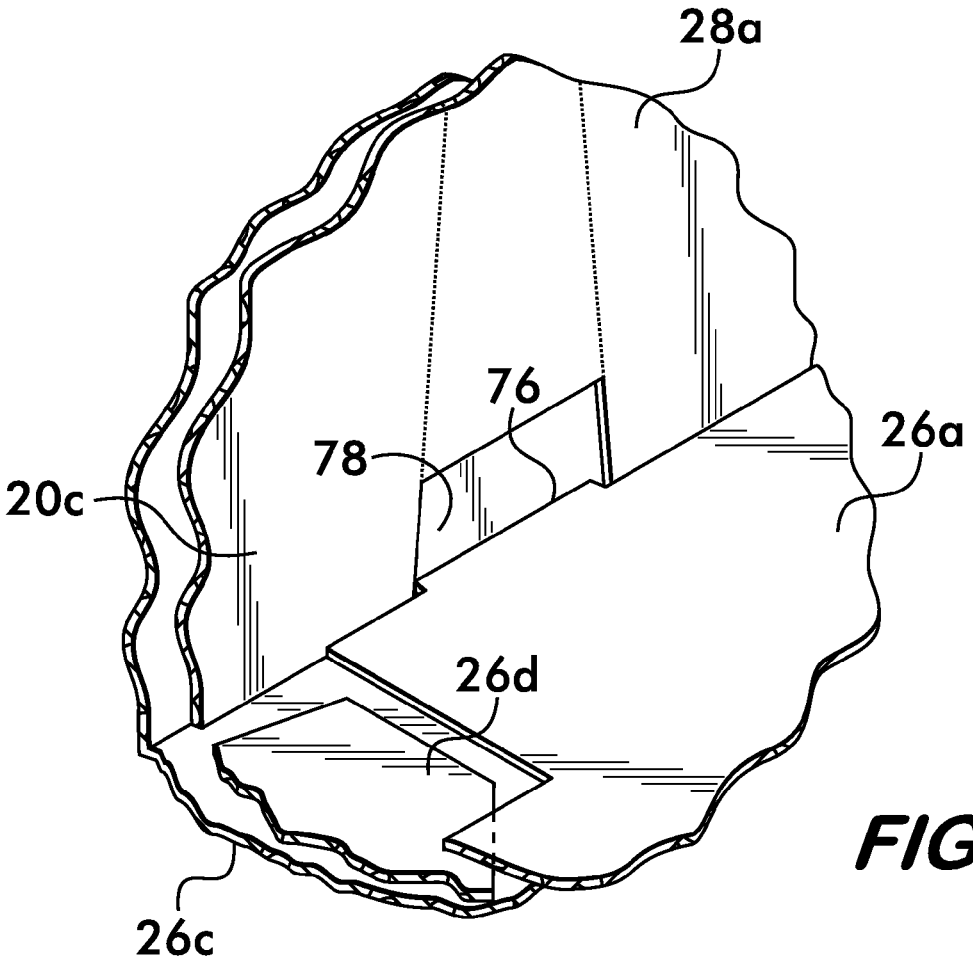
FIG. 17 is a plan view of a locking feature of the container of FIG. 16.

FIGS. 16 and 17 show upper and lower blanks for another embodiment of the present invention. The container formed by these blanks is identical to that shown above with the exception that the bottom flap 26*a* includes a locking tab 76 for engaging a space 78 under the tear away section 28*a* of wall panel 20*c* thereby preventing the container from opening accidentally if it is not fully assembled. FIG. 18 shows the locking tab 76 in the space 78 formed by the bottom of the tear away section 28*a* in an assembled container 10.

While a particular embodiment of the invention is described herein, it is not intended to limit the invention to such disclosure. Changes and modifications may be incorporated and embodied within the scope of the appended claims.

Those skilled in the art will also recognize that the present invention is not limited to the blanks illustrated. Other types of blanks may include self locking flaps for forming both top and bottom, and may include fold line means between the panels other than scored lines.

What is claimed is:

1. A container knockdown assembly capable of being erected into a container assembly, comprising:

an outer sleeve having panels for forming outer sleeve side walls, and flaps integrally connected to said side walls at one end, said flaps forming one of a bottom end or a top end of said container assembly when said knockdown assembly is erected;

a tab extending from at least one of said flaps of said outer sleeve;

an inner sleeve positioned inside said outer sleeve having panels for forming inner sleeve side walls and flaps integrally connected to said side walls at one end, said flaps forming an other one of said bottom end or said top end of said container assembly when said knockdown assembly is erected, said inner sleeve further comprising at least one adhesive overlay formed in said inner sleeve side walls by a tear line allowing said overlay to be detachable from said inner sleeve along said tear line;

an opening at one end of said at least one adhesive overlay for receiving said tab when said knockdown assembly is erected; and adhesive disposed between said outer sleeve side wall and said adhesive overlay so as to secure said inner and outer sleeves in an aligned relationship of the erected container assembly, and such that the adhesive overlay remains attached to said outer sleeve when said inner sleeve is detached from said outer sleeve.

2. The container knockdown assembly of claim 1, wherein said inner sleeve includes two or more adhesive overlays, each of which is independently adhered to said outer sleeve.

3. The container knockdown assembly of claim 2, wherein at least two of said adhesive overlays are spaced from one another on opposing side walls of said inner sleeve.

4. The container knockdown assembly of claim 1, wherein said adhesive is a hot melt glue.

5. The container knockdown assembly of claim 1, wherein said inner and outer sleeves form a substantially flat configuration in a knockdown configuration.

6. The container knockdown assembly of claim 1, wherein said aligned relationship of said inner and outer sleeves comprises aligning an edge of said inner sleeve side walls with a first fold line between said outer sleeve side walls and outer sleeve flaps and folding said outer sleeve flaps along said first fold line, and optionally a second fold line, back toward said inner sleeve side walls and into a central space of said knockdown assembly.

7. A container assembly erectable from the knockdown state set forth in claim 1.

8. A container knockdown assembly capable of being erected into a container assembly, comprising:

an outer sleeve having panels for forming outer sleeve side walls, and flaps integrally connected to said side walls at one end for forming a bottom end of the container assembly when said knockdown assembly is erected;

a tab extending from at least one of said flaps of said outer sleeve;

an inner sleeve positioned inside said outer sleeve and having panels for forming inner sleeve side walls and flaps integrally connected to said side walls at one end for forming a top end of the container assembly when said knockdown assembly is erected, said inner sleeve further comprising at least one adhesive overlay formed in said inner sleeve side walls by a tear line allowing said overlay to be detachable from said inner sleeve along said tear line;

an opening at one end of said at least one adhesive overlay for receiving said tab when said knockdown assembly is erected; and adhesive disposed between said outer sleeve side walls and said adhesive overlay so as to secure said inner and outer sleeves in an aligned relationship and such that the adhesive overlay remains attached to said outer sleeve side wall when detached from said inner sleeve.

9. The container knockdown assembly of claim 8, wherein said inner sleeve side walls include two or more adhesive overlays, each of which is independently adhered to said outer sleeve.

10. The container knockdown assembly of claim 9, wherein at least two of said adhesive overlays are spaced from one another on opposing side walls of said inner sleeve.

11. The container knockdown assembly of claim 8, wherein said opening is formed at a bottom edge of said inner sleeve panel.

12. The container knockdown assembly of claim 8, wherein said adhesive is a hot melt glue.

13. The container knockdown assembly of claim 8, wherein said inner and outer sleeves form a substantially flat configuration in a knockdown state.

14. The container knockdown assembly of claim 8, wherein said aligned relationship of said inner and outer sleeves comprises aligning a bottom edge of said inner sleeve side walls with a first fold line between said outer sleeve side wall and outer sleeve flap and folding said outer sleeve flaps along said first fold line, and optionally a second fold line, back toward said inner sleeve side walls and into a central space of said knockdown assembly.

15. The container knockdown assembly of claim 8, wherein said outer sleeve flaps are pivotal about a bottom end of said outer sleeve side walls from a position within a central space of said assembly to a position substantially perpendicular to said side walls thereby forming said bottom end of said container assembly, said bottom flaps including a first bottom flap attached to a first outer sleeve side wall and an adjacent bottom flap attached to an adjacent outer sleeve side wall, said adjacent outer sleeve side wall being pivotally attached to said first side wall, said adjacent bottom flap being pivotally attached to said first bottom flap in both said position within said central space and said position substantially perpendicular to said side walls such that said adjacent bottom flap and said first bottom flap, when pivoting into said position substantially perpendicular to said side walls, thereby self-deploys to define a container bottom portion when the knockdown assembly is erected.

16. A container assembly erectable from the knockdown state set forth in claim 8.

17. A container knockdown assembly capable of being erected into a container assembly, comprising:

an outer sleeve having panels for forming outer sleeve side walls and flaps integrally and pivotally connected to said side walls at a bottom end such that said flaps are pivotable from a position within a central space of said assembly to a position substantially perpendicular to said side walls thereby forming a bottom, said flaps including a first bottom flap attached to a first outer sleeve side wall and an adjacent bottom flap attached to an adjacent outer sleeve side wall, said adjacent outer sleeve side wall being pivotally attached to said first side wall, said adjacent bottom flap being pivotally attached to said first bottom flap in both said position within said central space and said position substantially perpendicular to said side walls such that said adjacent bottom flap and said first bottom flap, when pivoting into said position substantially perpendicular to said side walls, thereby self-deploys to define a bottom end of said container assembly when said knockdown assembly is erected;

a tab extending from at least one of said flaps of said outer sleeve;

an inner sleeve positioned inside said outer sleeve having panels for forming inner sleeve side walls and flaps integrally and pivotally connected to said panels at a top end for forming a top end of the container assembly, said inner sleeve further comprising at least one adhesive overlay formed in said inner sleeve side walls by a tear line allowing said overlay to be detachable from said inner sleeve along said tear line;

an opening at an end of said at least one adhesive overlay that is adjacent to a bottom edge of said inner sleeve side wall for receiving said tab when said knockdown assembly is erected; and adhesive disposed between said outer sleeve panel and said adhesive overlay so as to secure said inner and outer sleeves in an aligned relationship and such that the adhesive overlay remains attached to said outer container when detached from said inner sleeve.

18. A container assembly erectable from the knockdown state set forth in claim 17.

* * * * *